US011965388B2

(12) United States Patent
Madan et al.

(10) Patent No.: US 11,965,388 B2
(45) Date of Patent: Apr. 23, 2024

(54) REMOVING DEBRIS FROM A WELLBORE

(71) Applicant: Saudi Arabian Oil Company, Dhahran (SA)

(72) Inventors: Mohammed A. Madan, Sayhat (SA); Omar M. Alhamid, Dammam (SA); Talal A. Shihabuddin, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 17/731,528

(22) Filed: Apr. 28, 2022

(65) Prior Publication Data

US 2023/0349251 A1 Nov. 2, 2023

(51) Int. Cl.
*E21B 23/04* (2006.01)
*E21B 31/00* (2006.01)
*E21B 37/00* (2006.01)

(52) U.S. Cl.
CPC ..... *E21B 23/0412* (2020.05); *E21B 37/00* (2013.01); *E21B 31/00* (2013.01)

(58) Field of Classification Search
CPC ..... E21B 23/0412; E21B 37/00; E21B 31/00
See application file for complete search history.

(56) References Cited

U.S. PATENT DOCUMENTS 1,843,217 A 2/1932 Fletcher
2,874,781 A * 2/1959 McGaffey ..... E21B 31/08 166/167
3,020,957 A * 2/1962 Tausch ..... E21B 37/00 166/301
3,163,226 A * 12/1964 Lagucki ..... E21B 23/10 166/155
3,556,214 A * 1/1971 Kellner ..... E21B 31/00 166/98
3,822,750 A * 7/1974 Ping ..... E21B 21/16 166/309
5,074,361 A * 12/1991 Brisco ..... E21B 29/00 166/240

(Continued)

FOREIGN PATENT DOCUMENTS

CA 2719792 6/2015

OTHER PUBLICATIONS

Latch. In Merriam-Webster.com. Retrieved Sep. 15, 2023, from https://www.merriam-webster.com/dictionary/latch (Year: 2023).*

*Primary Examiner* — Robert E Fuller
*Assistant Examiner* — Neel Girish Patel
(74) *Attorney, Agent, or Firm* — Fish & Richardson P.C.

(57) ABSTRACT

A downhole tool includes a top sub-assembly configured to connect to a downhole conveyance that is operable to run the tool into a wellbore formed from a terranean surface to a subterranean formation; a housing coupled at an uphole end to the top sub-assembly, the housing defining an interior volume; a vacuum positioned in the interior volume and configured to generate a fluid suction; a debris chamber fluidly coupled to the vacuum and positioned in the interior volume; a nozzle coupled at a downhole end of the housing, the nozzle including one or more openings; and a controller communicably coupled to the vacuum and configured to perform operations including activating the vacuum to generate the fluid suction to circulate wellbore debris through the vacuum and into the debris chamber.

24 Claims, 5 Drawing Sheets

(56) References Cited

U.S. PATENT DOCUMENTS

| | | | | |
|---|---|---|---|---|
| 5,139,089 | A | 8/1992 | Wacker | |
| 5,791,712 | A * | 8/1998 | Hawn | E21B 31/18 294/86.15 |
| 6,059,030 | A * | 5/2000 | Celestine | E21B 21/10 166/227 |
| 6,719,056 | B2 | 4/2004 | Hoffman et al. | |
| 9,951,583 | B2 | 4/2018 | Gosselin et al. | |
| 2003/0188869 | A1* | 10/2003 | Tinker | E21B 31/00 166/99 |
| 2010/0258293 | A1* | 10/2010 | Lynde | E21B 23/00 166/66.4 |
| 2010/0258297 | A1* | 10/2010 | Lynde | E21B 37/00 166/105.1 |
| 2015/0345264 | A1* | 12/2015 | Johnson | E21B 43/128 166/105.1 |
| 2015/0345276 | A1* | 12/2015 | Jensen | E21B 27/00 166/105.3 |
| 2016/0365738 | A1* | 12/2016 | Romer | F04D 13/10 |
| 2019/0032432 | A1* | 1/2019 | Sommer | E21B 31/18 |
| 2019/0226301 | A1* | 7/2019 | Rahman | E21B 37/00 |
| 2020/0362661 | A1* | 11/2020 | Nordheimer | E21B 33/12 |
| 2021/0189845 | A1* | 6/2021 | Jabari | E21B 43/117 |

* cited by examiner

REMOVING DEBRIS FROM A WELLBORE

TECHNICAL FIELD

The present disclosure describes apparatus, systems, and methods for removing debris from a wellbore.

BACKGROUND

During drilling and workover operations, it can be required to run a cleaning tool or junk retrieval tool into the wellbore to remove any junk or dirt that might have settled within or on certain wellbore components. Sometimes, the junk and dirt restricts an ability to retrieve or connect to the wellbore components. Often, many wellbore trips are needed to conventionally remove the junk and debris and subsequently remove the wellbore components from the wellbore.

SUMMARY

In an example implementation, a downhole tool includes a top sub-assembly configured to connect to a downhole conveyance that is operable to run the tool into a wellbore formed from a terranean surface to a subterranean formation; a housing coupled at an uphole end to the top sub-assembly, the housing defining an interior volume; a vacuum positioned in the interior volume and configured to generate a fluid suction; a debris chamber fluidly coupled to the vacuum and positioned in the interior volume; a nozzle coupled at a downhole end of the housing, the nozzle including one or more openings; and a controller communicably coupled to the vacuum and configured to perform operations including activating the vacuum to generate the fluid suction to circulate wellbore debris through the vacuum and into the debris chamber.

An aspect combinable with the example implementation further includes a power source electrically coupled to the controller and the vacuum and configured to provide electrical power to the controller and the vacuum.

In another aspect combinable with any of the previous aspects, the power source includes one or more batteries.

In another aspect combinable with any of the previous aspects, the one or more batteries includes one or more rechargeable batteries configured to recharge with electrical power provided by the downhole conveyance that includes a wireline.

Another aspect combinable with any of the previous aspects further includes one or more latches positioned on an outer surface of the tool.

In another aspect combinable with any of the previous aspects, the one or more latches positioned on an outer surface of the nozzle.

In another aspect combinable with any of the previous aspects, the one or more latches is configured to snap into a profile of a wellbore component.

In another aspect combinable with any of the previous aspects, the wellbore component includes a plug.

In another example implementation, a method for removing debris in a wellbore includes running a downhole tool on a downhole conveyance into a wellbore formed from a terranean surface to a subterranean formation. The downhole tool includes a top sub-assembly connected to the downhole conveyance, a housing coupled at an uphole end to the top sub-assembly, where the housing defines an interior volume, a vacuum positioned in the interior volume, a debris chamber fluidly coupled to the vacuum and positioned in the interior volume, and a nozzle coupled at a downhole end of the housing, the nozzle including one or more openings. The method further includes positioning the downhole tool at a particular depth in the wellbore above a wellbore component mounted in the wellbore; activating the vacuum to generate a fluid suction; and circulating wellbore debris, with the fluid suction, through the vacuum and into the debris chamber.

An aspect combinable with the example implementation further includes providing electrical power to the vacuum from a power source positioned in the interior volume.

In another aspect combinable with any of the previous aspects, the power source includes one or more batteries, the method further including recharging the one or more batteries with electrical power provided by the downhole conveyance that includes a wireline.

In another aspect combinable with any of the previous aspects, circulating wellbore debris, with the fluid suction, through the vacuum and into the debris chamber includes circulating wellbore debris from am uphole surface of the wellbore component to uncover a profile of the wellbore component.

Another aspect combinable with any of the previous aspects further includes moving the downhole tool to contact the uphole surface of the wellbore component with the nozzle; and stinging one or more latches positioned on an outer surface of the nozzle into the profile of the wellbore component.

Another aspect combinable with any of the previous aspects further includes pulling the downhole tool out of the wellbore with the one or more latches stung into the profile to retrieve the wellbore component.

In another aspect combinable with any of the previous aspects, the wellbore component includes a plug.

Another aspect combinable with any of the previous aspects further includes determining that the downhole tool is at the particular depth in the wellbore.

In another aspect combinable with any of the previous aspects, determining that the downhole tool is at the particular depth includes at least one of determining, with a controller of the downhole tool, that the downhole tool is at the particular depth; or determining, with a downhole conveyance unit, that the downhole tool is at the particular depth.

In another aspect combinable with any of the previous aspects, activating the vacuum to generate the fluid suction includes automatically activating the vacuum by the controller when the downhole tool is at the particular depth.

Another aspect combinable with any of the previous aspects further includes determining that the automatic activation of the vacuum failed; and based on the determination, activating the vacuum by the downhole conveyance unit when the downhole tool is at the particular depth.

In another example implementation, a vacuum plug retrieval tool includes a housing configured to connect to a slickline that is operable to run the tool into a wellbore formed from a terranean surface to a subterranean formation; a debris chamber mounted in the housing; a nozzle coupled at a downhole end of the housing, the nozzle including one or more openings that are open to the wellbore; and a vacuum positioned in the housing and configured to generate a fluid suction when activated to circulate wellbore debris through the one or more openings, into at least a portion of the vacuum, and into the debris chamber.

An aspect combinable with the example implementation further includes a controller communicably coupled to the vacuum; and one or more batteries electrically coupled to the controller and the vacuum and configured to provide electrical power to the controller and the vacuum.

Another aspect combinable with any of the previous aspects further includes one or more mechanical dogs positioned on an outer surface of the nozzle.

In another aspect combinable with any of the previous aspects, the one or more mechanical dogs is configured to snap into a profile of a downhole plug.

Implementations of systems and methods for removing debris from a wellbore according to the present disclosure may include one or more of the following features. For example, systems and methods for removing debris from a wellbore according to the present disclosure can remove debris from on top of a wellbore component that would conventionally prevent such component from being stung into and retrieved. As another example, systems and methods for removing debris from a wellbore according to the present disclosure can remove debris from a wellbore component and retrieve the wellbore component to a surface in a single trip.

The details of one or more implementations of the subject matter described in this disclosure are set forth in the accompanying drawings and the description below. Other features, aspects, and advantages of the subject matter will become apparent from the description, the drawings, and the claims.

DETAILED DESCRIPTION

Figure 1:
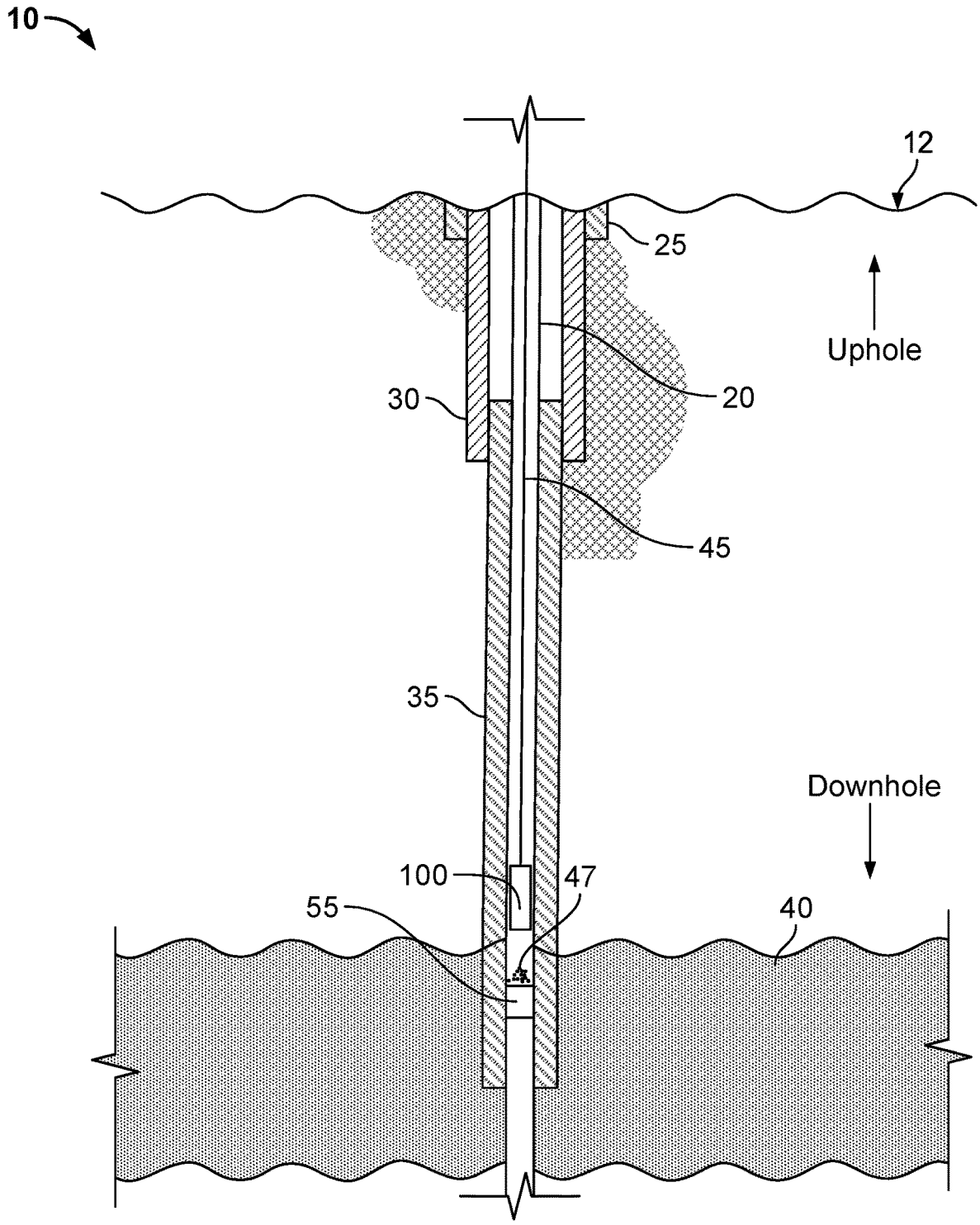
FIG. 1 is a schematic diagram of an example implementation of a wellbore system that includes a downhole tool for removing debris from a wellbore according to the present disclosure.

FIG. 1 is a schematic diagram of wellbore system 10 that includes a downhole tool 100 for removing debris in a wellbore according to the present disclosure. Generally, FIG. 1 illustrates a portion of one embodiment of a wellbore system 10 according to the present disclosure in which the downhole tool 100 can be run into a wellbore 20 and activated to remove debris 47 (for example, junk, particles, sand, and other debris) that are left or found within the wellbore 20, such as adjacent or on top of a wellbore component 55. In this example, the downhole tool 100 is connected to a downhole conveyance 45 during run in and run out operations in the wellbore 20. The downhole conveyance 45 can be, for example, a wireline or slickline, or other conductor. In alternative examples, the downhole conveyance 45 can be a tubing string (for example, drill string comprised of drill pipe sections, tubing work string or coiled tubing).

According to the present disclosure, the downhole tool 100 can be run into the wellbore 20 in order to remove all or a portion of debris 47 that are found in the wellbore 20, such as adjacent or on top of the wellbore component 55. In some aspects, the wellbore component 55 can be a removable wellbore seal (for example, plug, packer, or other component). As a removable wellbore component, the debris 47 can interfere with a removal tool's ability to, for example, detach the wellbore component 55 from within the wellbore 20 (for example, from a wellbore tubular) and run the wellbore component 55 out of the wellbore 20. In some aspects, the downhole tool 100 can be operated to remove the debris 47 that settles on top of the wellbore component 55, as well as retrieve the wellbore component 55 from the wellbore 20 when necessary. The downhole tool 100 can, therefore, eliminate or reduce a number of trips into or out of the wellbore that are conventionally required for debris/junk removal and component retrieval.

As shown, the wellbore system 10 accesses the subterranean formation 40 (and other formations) and provides access to hydrocarbons located in such subterranean formation 40. In an example implementation of system 10, the system 10 may be used for a production operation in which the hydrocarbons may be produced from the subterranean formation 40 within a wellbore tubular (for example, through the production casing 35 or other production tubular).

A drilling assembly (not shown) may be used to form the wellbore 20 extending from the terranean surface 12 and through one or more geological formations in the Earth. One or more subterranean formations, such as subterranean formation 40, are located under the terranean surface 12. One or more wellbore casings, such as a surface casing 30 and production casing 35, may be installed in at least a portion of the wellbore 20. In some embodiments, a drilling assembly used to form the wellbore 20 may be deployed on a body of water rather than the terranean surface 12. For instance, in some embodiments, the terranean surface 12 may be an ocean, gulf, sea, or any other body of water under which hydrocarbon-bearing formations may be found. In short, reference to the terranean surface 12 includes both land and water surfaces and contemplates forming and developing one or more wellbore systems 10 from either or both locations.

In some embodiments of the wellbore system 10, the wellbore 20 may be cased with one or more casings. As illustrated, the wellbore 20 includes a conductor casing 25, which extends from the terranean surface 12 shortly into the Earth. A portion of the wellbore 20 enclosed by the conductor casing 25 may be a large diameter borehole. Additionally, in some embodiments, the wellbore 20 may be offset from vertical (for example, a slant wellbore). Even further, in some embodiments, the wellbore 20 may be a stepped wellbore, such that a portion is drilled vertically downward and then curved to a substantially horizontal wellbore portion. Additional substantially vertical and horizontal wellbore portions may be added according to, for example, the type of terranean surface 12, the depth of one or more target subterranean formations, the depth of one or more productive subterranean formations, or other criteria.

Downhole of the conductor casing 25 may be the surface casing 30. The surface casing 30 may enclose a slightly smaller borehole and protect the wellbore 20 from intrusion of, for example, freshwater aquifers located near the terranean surface 12. The wellbore 20 may than extend vertically downward. This portion of the wellbore 20 may be enclosed by the production casing 35. Any of the illustrated casings, as well as other casings or tubulars that may be present in the wellbore system 10, may include wellbore liners in which the wellbore component 55 can be installed.

Figure 2:
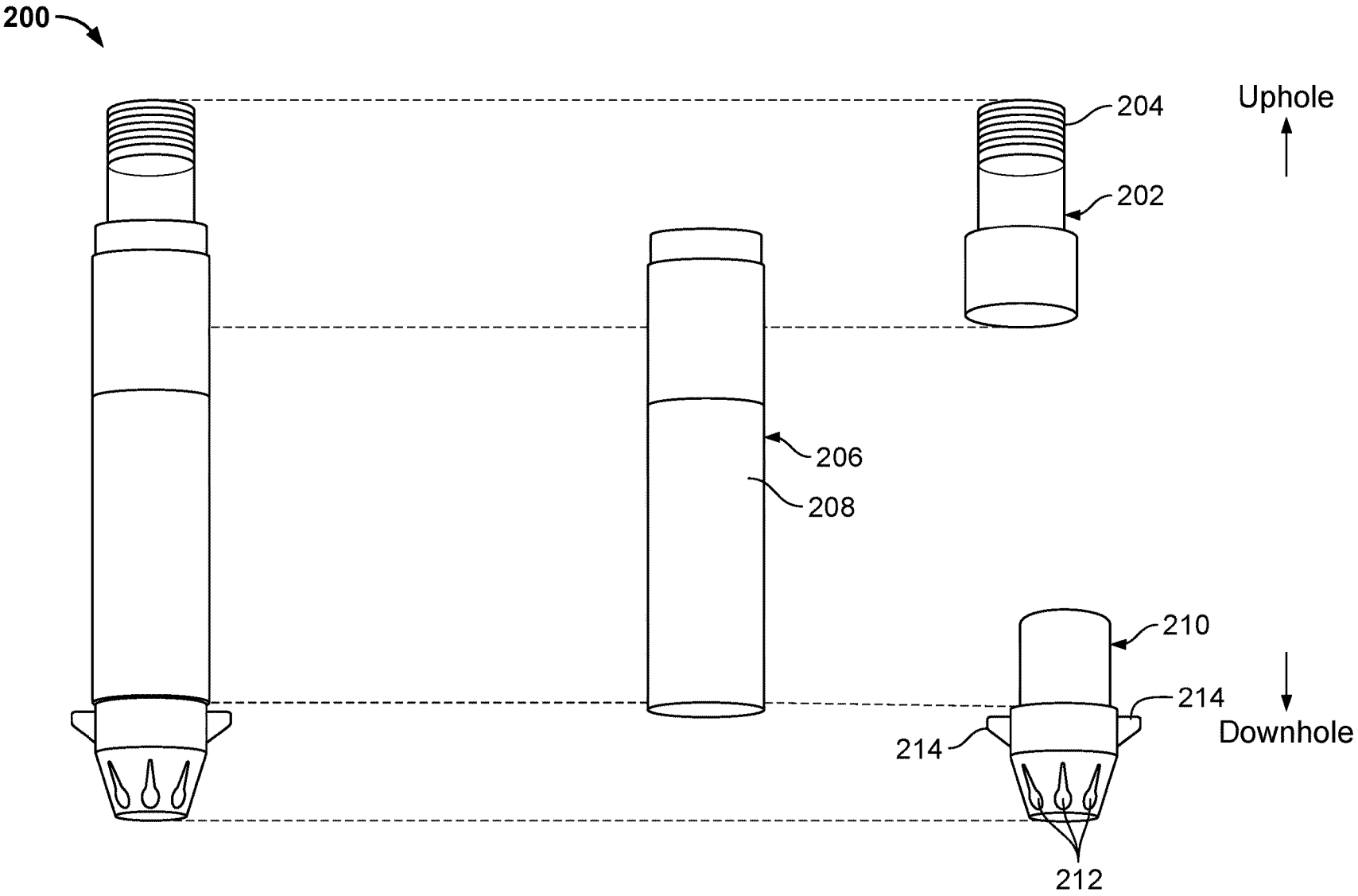
FIG. 2 is a schematic illustration of an example implementation of a downhole tool for removing debris from a wellbore according to the present disclosure.

FIG. 2 is a schematic illustration of an example implementation of a downhole tool 200 for removing debris from a wellbore according to the present disclosure. In some aspects, downhole tool 200 can be used in the wellbore system 10 as the downhole tool 100 for removing debris 47. As shown in this example implementation, the downhole tool 200 includes a top sub-assembly 202 that includes a conveyance connection 204 configured to connect to a downhole conveyance, such as, for example, a slickline or wireline (or a tubular conveyance) as appropriate. For instance, in an example implementation, the conveyance connection 204 is connectable to a slickline that is operable for tripping the downhole tool 200 in and out of a wellbore.

The example implementation of the downhole tool 200 also includes a housing 206 that connects to the top sub-assembly 202 (for example, threadingly or otherwise). The housing 206 defines an interior volume 208 into which one or more debris collector components can be positioned (as explained in more detail with reference to FIG. 3). Although shown as a cylindrical component, the housing 206 can have any particular cross-sectional shape as appropriate.

As further shown, the downhole tool 200 includes a nozzle 210 that connects to the housing 206 (for example, threadingly or otherwise). In this implementation, the nozzle 210 includes one or more openings 212 that are positioned to fluidly couple the nozzle 210 (and housing 206) to a wellbore when the downhole tool 200 is positioned within the wellbore (for example, to remove debris). As further shown, the nozzle 210 includes one or more latches 214 (for example, mechanical dogs) positioned on an exterior surface of the nozzle 210. In some aspects, the latches 214 are shaped and positioned to engage one or more profiles of a wellbore component in order to connect the downhole tool 200 with the wellbore component (for instance, to retrieve the wellbore component to a surface).

Figure 3:
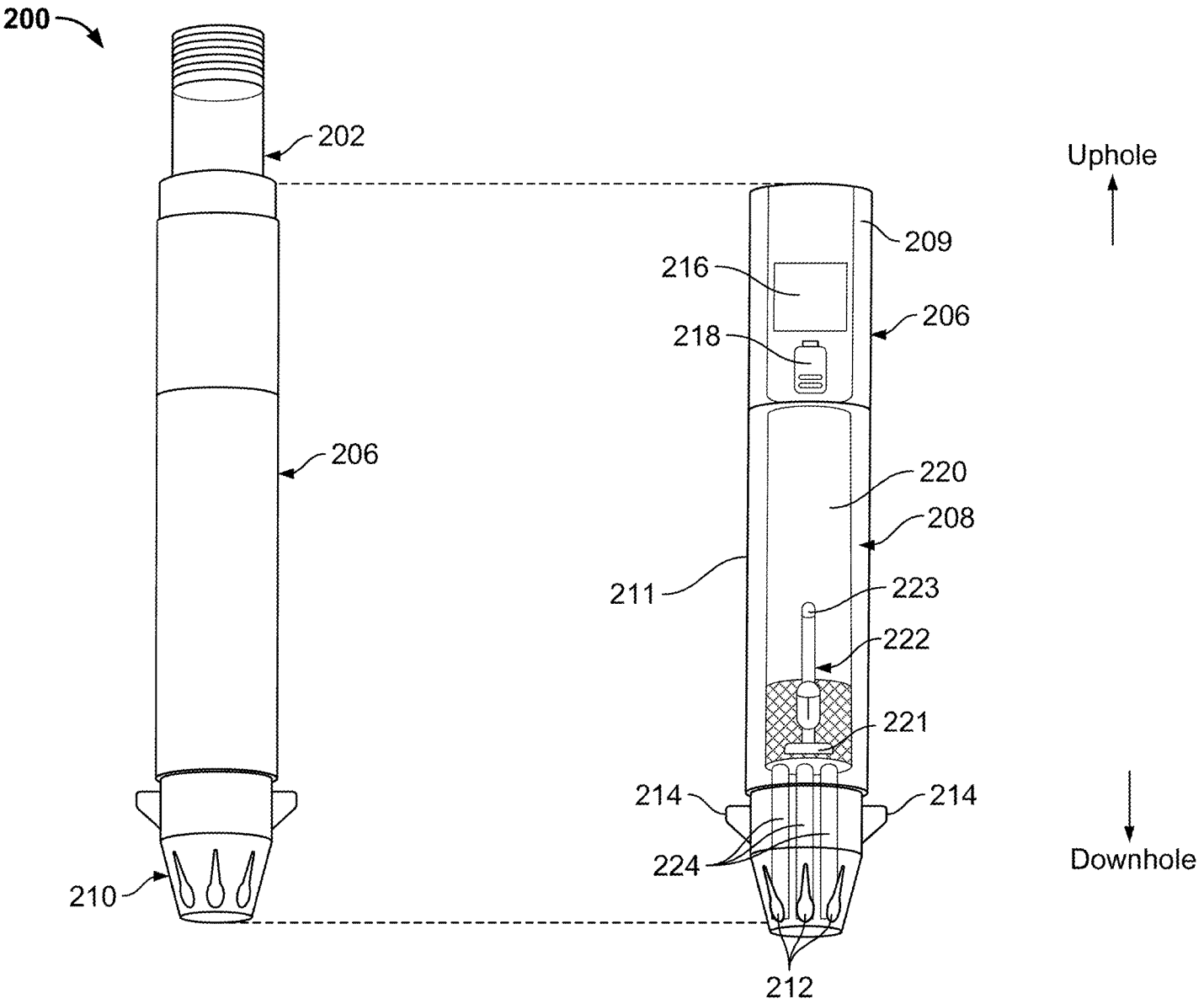
FIG. 3 is a schematic illustration of one or more internal components of an example implementation of a downhole tool for removing debris from a wellbore according to the present disclosure.

FIG. 3 is a schematic illustration of one or more internal components of the example implementation of the downhole tool 200. As shown in FIG. 3, the housing 206 (and specifically the volume 208), can be divided (physically or nominally) into a top (or uphole) section 209 and a bottom (or downhole) section 211. As shown in this example implementation, the top section 209 includes a controller 216 and a power source 218. In certain example implementations, the controller 216 comprises a mechanical controller or an electro-mechanical controller. In some aspects, the controller 216 can be a microprocessor-based controller. The controller 216 can be used for the operations described in association with any of the computer-implemented methods described previously. The controller 216, in these aspects, is intended to include various forms of digital computing hardware. Generally, the controller 216 can include one or more processors, one or more memory components, and, in some aspects, an input/output device. Each of the components can be interconnected using a system bus.

Certain features of the described controller 216 can be implemented in digital electronic circuitry in the controller, or in computer hardware, firmware, software, or in combinations of them. Features can be implemented in a computer program product tangibly embodied in an information carrier, for example, in a machine-readable storage device for execution by a programmable processor; and method steps can be performed by a programmable processor executing a program of instructions to perform functions of the described implementations by operating on input data and generating output. The described features can be implemented advantageously in one or more computer programs that are executable on a programmable system including at least one programmable processor coupled to receive data and instructions from, and to transmit data and instructions to, a data storage system, at least one input device, and at least one output device. A computer program is a set of instructions that can be used, directly or indirectly, in a computer to perform a certain activity or bring about a certain result. A computer program can be written in any form of programming language, including compiled or interpreted languages, and it can be deployed in any form, including as a stand-alone program or as a module, component, subroutine, or other unit suitable for use in a computing environment.

In this example, the power source 218 can be or include one or more batteries (for example, lithium ion batteries or otherwise) or other independent power source (for example, piezoelectric (PE) wafers, fluid driven turbine, thermoelectric generators) that can provide, for example, electrical power to the controller 216 (as well as other components of the downhole tool 200). For instance, in aspects in which the downhole tool 200 is attached to a slickline downhole conveyance, the power source 218 can provide all power for the downhole tool 200. Alternatively, in aspects in which the downhole tool 200 is attached to a wireline downhole conveyance, the power source 218 can be charged by the wireline and provide some (in combination with the wireline) or all power for the downhole tool 200.

As further shown in FIG. 3, the bottom section 211 of the volume 208 includes a debris chamber 220 and a vacuum 222 (for example, a suction pump). In this example, an inlet of the vacuum 222 is located at a downhole end adjacent or within the nozzle 210, while an outlet of the vacuum 222 is located adjacent or within the debris chamber 220. For instance, the outlet of the vacuum 222 can be positioned within the debris chamber 220 so that debris forcibly circulated (through a fluid suction 224) into the inlet of the vacuum 222 (by operation of the vacuum 222) from the openings 212 are provided into the debris chamber 220 for storage. In some aspects, one or more filters (for example, mesh screens) can be positioned at one or more locations, such as at an inlet 221 of the vacuum 222, at an outlet 223 of the vacuum 222, and/or at the openings 212.

In this example, the vacuum 222 is also in communication with the controller 216 (for instance, to receive activation and/or deactivation commands from the controller 216, as well as, in some aspects, vacuum motor speed settings from the controller 216). The vacuum 222 can also be electrically connected to the power source 218 to receive electrical power from the source 218.

Figure 4B:
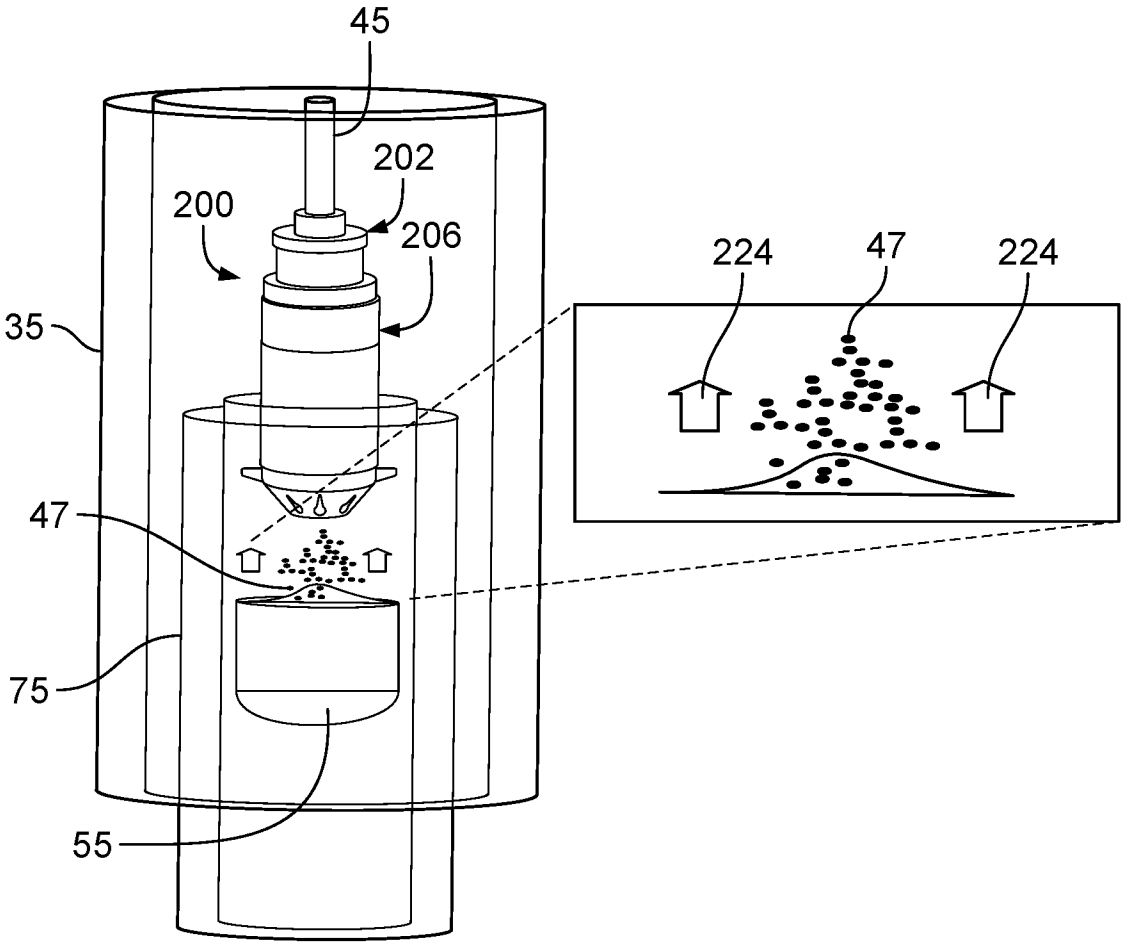
FIGS. 4A-4D are schematic illustrations of an example operation of removing debris from a wellbore by an example implementation of a downhole tool according to the present disclosure.
Figure 4A:
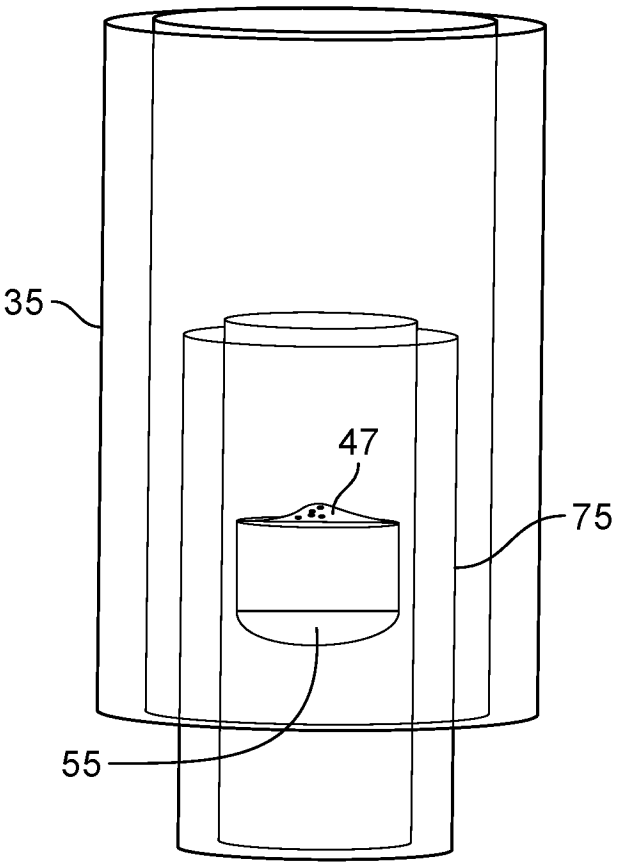

FIGS. 4A-4D are schematic illustrations of an example operation of removing debris from a wellbore by the example implementation of the downhole tool 200. The example operation illustrated in FIGS. 4A-4D can also include removal of a wellbore component from the wellbore with the downhole tool 200 once the debris have been removed. Turning first to FIG. 4A, this figure illustrates the wellbore component 55—in this example a plug 55—within a tubular 75 (such as a wellbore liner or otherwise) that is mounted in the casing 35. As shown in FIG. 4A, debris 47 (sand, particles, fines, other junk) have been deposited on a top or uphole surface of the plug 55. In some aspects, therefore, the debris 47 may cover or interfere with one or more profiles of the plug 55 that allow the plug 55 to be removed from the tubular 75.

Turning now to FIG. 4B, the downhole tool 200 can be run into the casing 35 (and into the tubular 75) on the downhole conveyance 45. In some aspects, the downhole tool 200 can be run to a pre□set depth of, for example, 10-15 feet above a known depth of the plug 55. This depth, in some aspects, can be programmed into the controller 216 at the surface. The downhole tool 200 can then be run (for example, on slickline) to the programmed depth, at which the controller 216 can stop the movement of the downhole tool 200 (or movement can be stopped at the surface by the slickline control, which is then signaled to the controller 216 that depth has been reached).

In some aspects, the pre-set depth is the primary activation technique for activating the vacuum 222. In some aspects, a secondary activation technique can also be implemented, such as a signal that is transmitted from the surface, through the downhole conveyance (for example, slickline or wireline) to the controller 216, which in turn activates the vacuum 222 based on the signal. In some aspects, the secondary activation technique is implemented (for example, automatically or manually) when the primary activation technique fails to activate the vacuum 222. For instance, an activation switch or button on a slickline unit can manually send the signal to the controller 216 to activate and start the vacuum 222.

FIG. 4B illustrates the downhole tool 200 at the pre-programmed depth, at which the controller 216 can signal the vacuum 222 to activate (at which time the power source 218 can provide power to the vacuum 222). Upon activation, the fluid suction 224 is drawn into the openings 212, which also draws the debris 47 (within the fluid suction 224) into the openings 212. The debris 47 within the fluid suction 224 can be circulated through the vacuum 222 and into the debris chamber 220 (for storage until removal at the surface). Once the debris 47 have been removed from the plug 55 into the chamber 220, or after operation of the vacuum 222 for a particular period of time, the vacuum 222 can be deactivated by the controller 216 as shown in FIG. 4C.

Figures 4C, 4D:
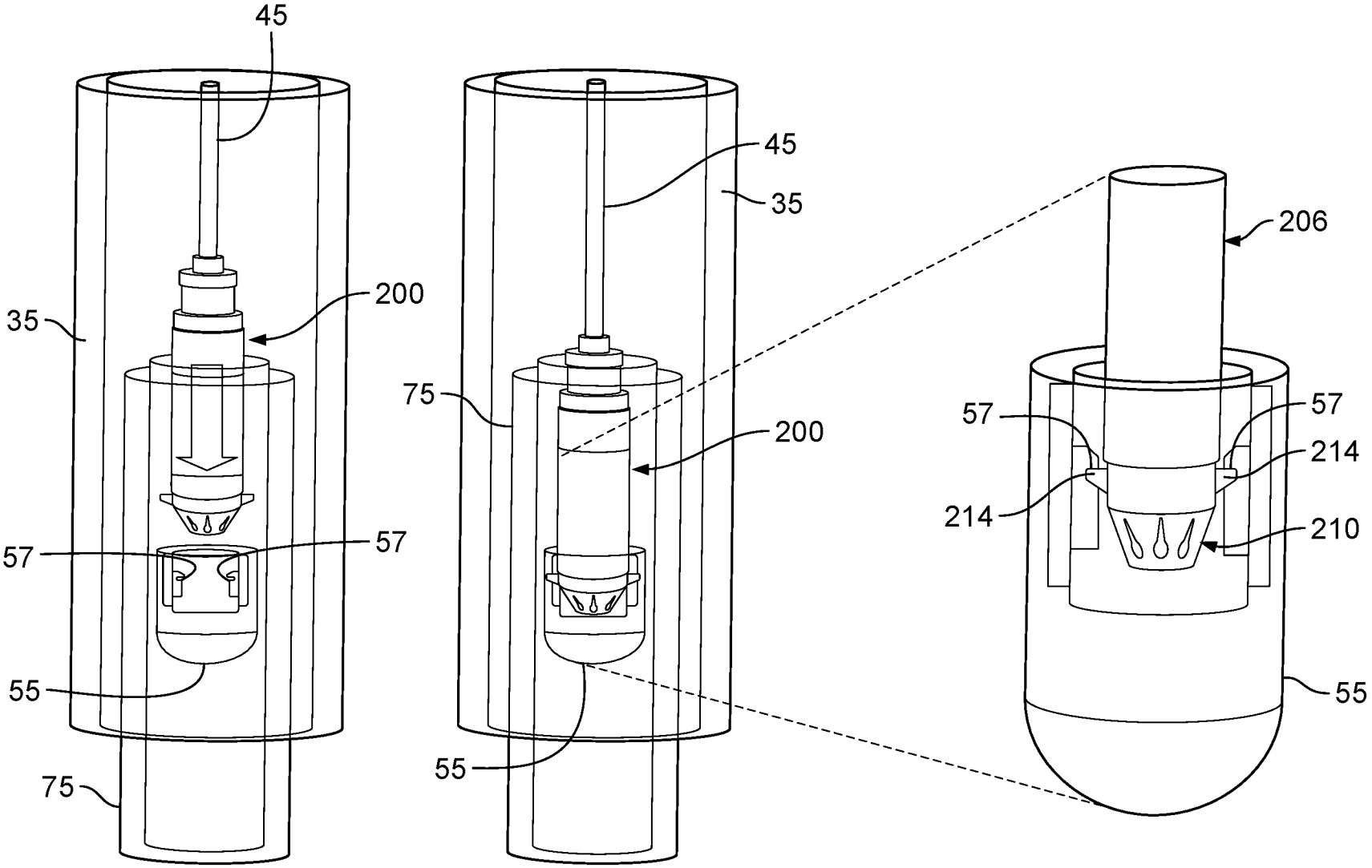

As shown in FIG. 4C, once the downhole tool 300 has removed the debris 47 from the plug 55, the downhole conveyance 45 can be operated to move (as shown by the arrow) the downhole tool 200 downhole toward the plug 55. Turning now to FIG. 4D, the downhole tool 200 is shown connected to the plug 55. In this example implementation, the downhole tool 200 can be set into a profile 57 (or one or more profiles) of the plug 55 such that the latches 214 engage the profiles 57. In some aspects, the latches 214 can be biased (for example, with one or more springs) to snap into the profile 57. Thus, once the downhole tool 200 is moved downhole until the top of the plug 55 is tagged, the downhole tool 200 can be stung into the plug 55 (with the latches 214 engaging the profile 57). Once stung into the plug 55, the downhole conveyance 45 can be moved uphole, and the downhole tool 200 can retrieve the plug 55 from the tubular 75. When the downhole tool 200 is retrieved to the surface (with or without retrieving the plug 55), the debris chamber 220 can be emptied of debris 47.

A number of implementations have been described. Nevertheless, it will be understood that various modifications may be made without departing from the spirit and scope of the disclosure. For example, example operations, methods, or processes described herein may include more steps or fewer steps than those described. Further, the steps in such example operations, methods, or processes may be performed in different successions than that described or illustrated in the figures. Accordingly, other implementations are within the scope of the following claims.

What is claimed is:

1. A downhole tool, comprising:

a top sub-assembly configured to connect to a downhole conveyance that is operable to run the tool into a wellbore formed from a terranean surface to a subterranean formation;

a housing coupled at an uphole end to the top sub-assembly, the housing defining an interior volume;

a vacuum positioned in the interior volume and configured to generate a fluid suction;

a debris chamber fluidly coupled to the vacuum and positioned in the interior volume;

a nozzle coupled at a downhole end of the housing, the nozzle comprising one or more openings;

one or more latches positioned on an outer surface of the tool, the one or more latches configured to snap into a profile of a wellbore component; and a controller communicably coupled to the vacuum and configured to perform operations comprising:

determining that the downhole tool is at a programmed depth in the wellbore uphole of the wellbore component; and based on the determination that the downhole tool is at the programmed depth, automatically activating the vacuum to generate the fluid suction to circulate wellbore debris through the vacuum and into the debris chamber.

2. The downhole tool of claim 1, further comprising a power source electrically coupled to the controller and the vacuum and configured to provide electrical power to the controller and the vacuum.

3. The downhole tool of claim 2, wherein the power source comprises one or more batteries.

4. The downhole tool of claim 3, wherein the one or more batteries comprises one or more rechargeable batteries configured to recharge with electrical power provided by the downhole conveyance that comprises a wireline.

5. The downhole tool of claim 4, wherein the one or more latches is positioned on an outer surface of the nozzle.

6. The downhole tool of claim 5, wherein the wellbore component comprises a plug.

7. The downhole tool of claim 1, wherein the one or more latches is positioned on an outer surface of the nozzle.

8. The downhole tool of claim 1, wherein the wellbore component comprises a plug.

9. The downhole tool of claim 1, wherein the programmed depth is 10-15 feet uphole of the wellbore component.

10. A method for removing debris in a wellbore, comprising:

running a downhole tool on a downhole conveyance into the wellbore formed from a terranean surface to a subterranean formation, the downhole tool comprising:

a top sub-assembly connected to the downhole conveyance, a housing coupled at an uphole end to the top sub-assembly, the housing defining an interior volume, a vacuum positioned in the interior volume, a debris chamber fluidly coupled to the vacuum and positioned in the interior volume, and a nozzle coupled at a downhole end of the housing, the nozzle comprising one or more openings;

positioning the downhole tool at a particular depth in the wellbore above a wellbore component mounted in the wellbore;

determining that the downhole tool is at the particular depth in the wellbore, the determining comprising:

determining, with a controller of the downhole tool, that the downhole tool is at the particular depth, or determining, with a downhole conveyance unit, that the downhole tool is at the particular depth;

activating the vacuum to generate a fluid suction, the activating comprising automatically activating the vacuum by the controller when the downhole tool is at the particular depth;

determining that the automatic activation of the vacuum failed;

based on the determination, activating the vacuum by the downhole conveyance unit when the downhole tool is at the particular depth; and circulating wellbore debris, with the fluid suction, through the vacuum and into the debris chamber.

11. The method of claim 10, further comprising providing electrical power to the vacuum from a power source positioned in the interior volume.

12. The method of claim 11, wherein the power source comprises one or more batteries, the method further comprising recharging the one or more batteries with electrical power provided by the downhole conveyance that comprises a wireline.

13. The method of claim 11, wherein circulating wellbore debris, with the fluid suction, through the vacuum and into the debris chamber comprises circulating wellbore debris from am uphole surface of the wellbore component to uncover a profile of the wellbore component.

14. The method of claim 13, further comprising:

moving the downhole tool to contact the uphole surface of the wellbore component with the nozzle; and stinging one or more latches positioned on an outer surface of the nozzle into the profile of the wellbore component.

15. The method of claim 14, further comprising:

pulling the downhole tool out of the wellbore with the one or more latches stung into the profile to retrieve the wellbore component.

16. The method of claim 15, wherein the power source comprises one or more batteries, the method further comprising recharging the one or more batteries with electrical power provided by the downhole conveyance that comprises a wireline.

17. The method of claim 10, wherein circulating wellbore debris, with the fluid suction, through the vacuum and into the debris chamber comprises circulating wellbore debris from am uphole surface of the wellbore component to uncover a profile of the wellbore component.

18. The method of claim 17, further comprising:

moving the downhole tool to contact the uphole surface of the wellbore component with the nozzle; and stinging one or more latches positioned on an outer surface of the nozzle into the profile of the wellbore component.

19. The method of claim 18, further comprising:

pulling the downhole tool out of the wellbore with the one or more latches stung into the profile to retrieve the wellbore component.

20. The method of claim 18, wherein the wellbore component comprises a plug.

21. A vacuum plug retrieval tool, comprising:

a housing configured to connect to a slickline that is operable to run the tool into a wellbore formed from a terranean surface to a subterranean formation;

a debris chamber mounted in the housing;

a nozzle coupled at a downhole end of the housing, the nozzle comprising one or more openings that are open to the wellbore; and a vacuum positioned in the housing and configured to generate a fluid suction when activated to circulate wellbore debris through the one or more openings, into at least a portion of the vacuum, and into the debris chamber;

one or more mechanical dogs positioned on an outer surface of the nozzle; and a control system communicably coupled to the vacuum, the control system configured to perform operations comprising:

determining that the tool is at a programmed depth in the wellbore uphole of a downhole plug; and based on the determination that the tool is at the programmed depth, automatically activating the vacuum to generate the fluid suction to circulate wellbore debris through the one or more openings from the downhole plug.

22. The vacuum plug retrieval tool of claim 21, further comprising:

one or more batteries electrically coupled to the control system and the vacuum and configured to provide electrical power to the control system and the vacuum.

23. The vacuum plug retrieval tool of claim 21, wherein the one or more mechanical dogs is configured to snap into a profile of the downhole plug.

24. The vacuum plug retrieval tool of claim 22, wherein the one or more mechanical dogs is configured to snap into a profile of the downhole plug.

* * * * *